US011802497B2

(12) United States Patent
Sliwa et al.

(10) Patent No.: US 11,802,497 B2
(45) Date of Patent: Oct. 31, 2023

(54) INTERNAL COMBUSTION ENGINE INCLUDING AN OIL COOLER INTEGRATED INTO THE CYLINDER BLOCK, AND COOLING WATER CONTROL

(71) Applicant: DEUTZ Aktiengesellschaft, Cologne (DE)

(72) Inventors: Marco Sliwa, Siegburg (DE); Johannes Klosterberg, Swisttal (DE)

(73) Assignee: Deutz Aktiengesellschaft, Cologne (DE)

( * ) Notice: Subject to any disclaimer, the term of this patent is extended or adjusted under 35 U.S.C. 154(b) by 0 days.

(21) Appl. No.: 17/641,308

(22) PCT Filed: Sep. 17, 2020

(86) PCT No.: PCT/IB2020/000158
§ 371 (c)(1),
(2) Date: Mar. 8, 2022

(87) PCT Pub. No.: WO2021/058124
PCT Pub. Date: Apr. 1, 2021

(65) Prior Publication Data

US 2022/0290588 A1 Sep. 15, 2022

(30) Foreign Application Priority Data

Sep. 23, 2019 (DE) ..... 10 2019 006 664.2

(51) Int. Cl.
*F01M 5/00* (2006.01)
*F01P 3/20* (2006.01)

(52) U.S. Cl.
CPC ..... *F01M 5/002* (2013.01); *F01P 3/20* (2013.01); *F01P 2060/04* (2013.01)

(58) Field of Classification Search
CPC .. F01M 11/03; F01M 9/10; F01M 1/10; F02F 7/0073
See application file for complete search history.

(56) References Cited

U.S. PATENT DOCUMENTS 5,477,817 A 12/1995 Hufendiek et al.
5,487,363 A 1/1996 Batzill et al.
2006/0130781 A1* 6/2006 Oshita ..... F02B 67/06 123/54.4

(Continued)

FOREIGN PATENT DOCUMENTS

DE 2034203 A1 6/1971
DE 4313506 A1 10/1994

(Continued)

OTHER PUBLICATIONS

International Search Report for PCT/EP2020/000158, dated Dec. 15, 2020.

*Primary Examiner* — Long T Tran
(74) *Attorney, Agent, or Firm* — Davidson, Davidson & Kappel, LLC

(57) ABSTRACT

An internal combustion engine including a crankcase and a cylinder head are described, including at least one cylinder block, at least one flat flange surface for accommodating at least one oil cooler, at least one oil cooler, at least one coolant inlet to the oil cooler, at least one coolant outlet from the oil cooler, and at least one internal cooling section.

9 Claims, 4 Drawing Sheets

(56) References Cited

U.S. PATENT DOCUMENTS

| | | | | |
|---|---|---|---|---|
| 2009/0314230 | A1* | 12/2009 | Nagenkogl | F01M 13/04 123/573 |
| 2011/0214628 | A1 | 9/2011 | Honzen et al. | |
| 2012/0160208 | A1* | 6/2012 | Takano | F01M 1/10 123/196 A |
| 2017/0159517 | A1* | 6/2017 | Mori | F01M 9/107 |

FOREIGN PATENT DOCUMENTS

| | | | | |
|---|---|---|---|---|
| DE | 4322030 | A1 | 1/1995 | |
| DE | 4400952 | C1 | 5/1995 | |
| DE | 10 2005040635 | A1 | 3/2007 | |
| EP | 2375025 | B1 | 2/2015 | |
| EP | 3441592 | A1 * | 2/2019 | F01M 1/10 |
| EP | 3441592 | A1 | 2/2019 | |

* cited by examiner

C-C

INTERNAL COMBUSTION ENGINE INCLUDING AN OIL COOLER INTEGRATED INTO THE CYLINDER BLOCK, AND COOLING WATER CONTROL

BACKGROUND

According to DE 10 2005 040 635 A1, a quantity of water is conveyed into an oil cooler line, not illustrated, that extends along the crankcase cooling chambers and feeds an oil cooler that is integrated at the internal combustion engine. The water is led from the oil cooler, via the cylinder head cooling chamber, and supplied to the cooling water thermostat.

DE 43 22 030 A1 provides an oil pan that includes cooling ribs, for which a separate oil cooler may be dispensed with.

It is also known from EP 2 375 025 B1 to provide multiple heat exchangers downstream from the cylinder head.

It is disadvantageous that either no oil cooler, and thus in cases of doubt, insufficient oil cooling power, is present, or the conduction paths for externally situated oil coolers are too long and complicated.

SUMMARY

It is an object of the present disclosure to avoid the above-mentioned disadvantages and provide an oil cooler that is favorable in terms of flow and that ensures an effective supply of oil and water or cooling medium to the oil cooler with as little piping as possible.

The present disclosure provides an internal combustion engine including a crankcase and a cylinder head, including at least one cylinder block, at least one flat flange surface for accommodating at least one oil cooler, at least one oil cooler, at least one coolant inlet to the oil cooler, at least one coolant outlet from the oil cooler, at least one oil inlet to the oil cooler, at least one integrated oil passage from the oil cooler, and at least one internal cooling section. The present disclosure also provides a method for operating an internal combustion engine.

The leakage losses are reduced to a minimum with the aid of this approach. The flow speeds and thus the cooling effect at oil cooler are in turn greatly increased or improved. Due to the option of being able to adapt the machining at the crankcase at any time, it is also possible to respond at any time to changes in design of the oil cooler.

BRIEF DESCRIPTION OF THE DRAWINGS

The present disclosure is explained in greater detail below based on two exemplary embodiments.

DETAILED DESCRIPTION

Figure 1:
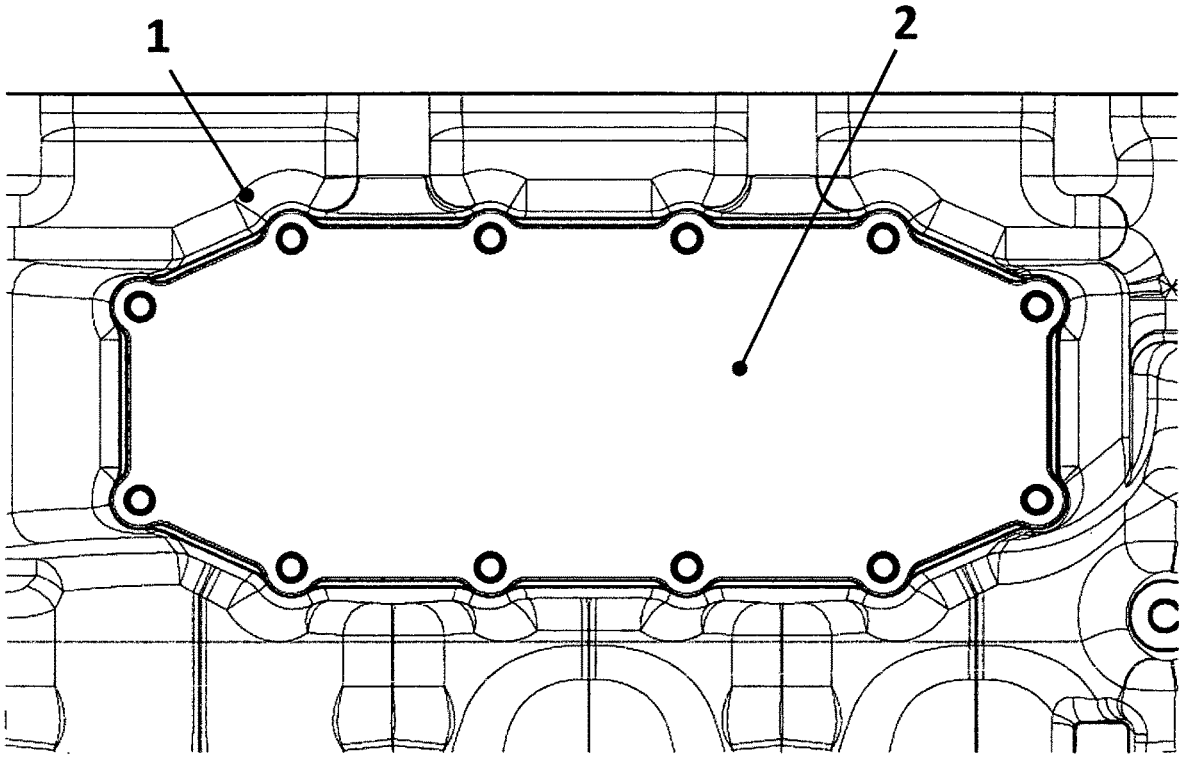
FIG. 1 shows an installed oil cooler at the crankcase.

The oil cooler illustrated in FIG. 1, due to the contour of crankcase receptacle 3 in crankcase 1, is covered by oil cooler cover 2 in a watertight manner. The cooling water thus flows around oil cooler 5. The cooling water is conducted through oil cooler 5.

Figure 2:
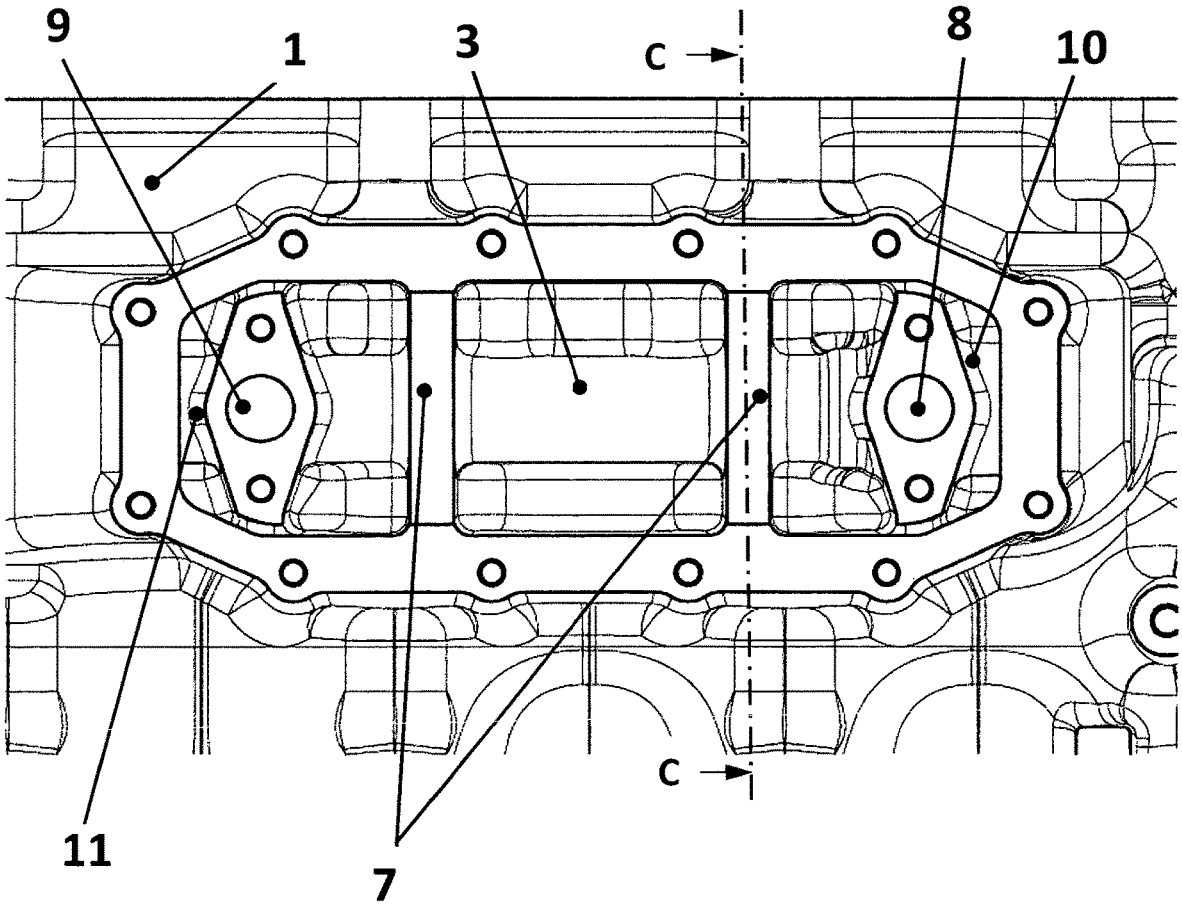
FIG. 2 shows a crankcase including a receptacle for accommodating the oil cooler.

FIG. 2 shows crankcase 1 including crankcase receptacle 3 for accommodating oil cooler 5. Situated within crankcase receptacle 3, which is integrated into crankcase 1 and bordered by a flange for sealingly accommodating oil cooler cover 2, are two cast metal ribs 7, oil inlet 8 and oil outlet 9 on whose flanges oil cooler 5 is situated, and coolant inlet 10 and coolant outlet 11, which are molded into the crankcase and open out into crankcase receptacle 3. The sealing of the water circuit in the area of oil cooler 5 takes place with the aid of oil cooler cover 2.

Figure 3:
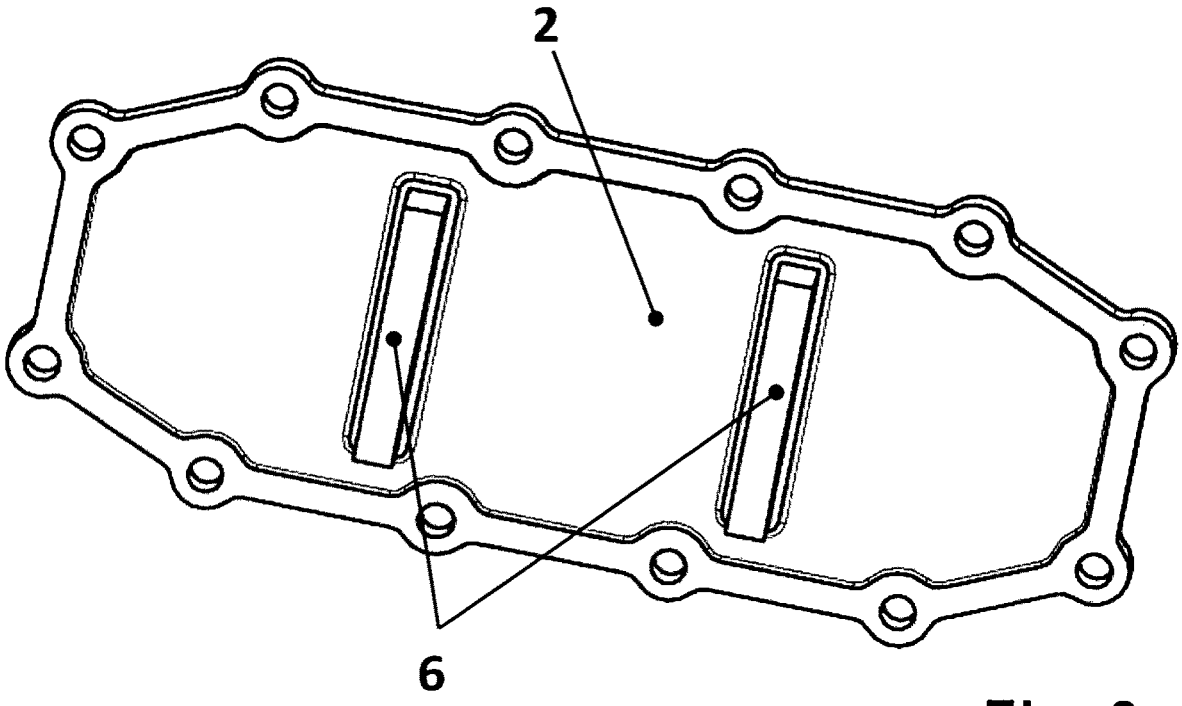
FIG. 3 shows an oil cooler cover with interior guide ribs.
Figure 5:
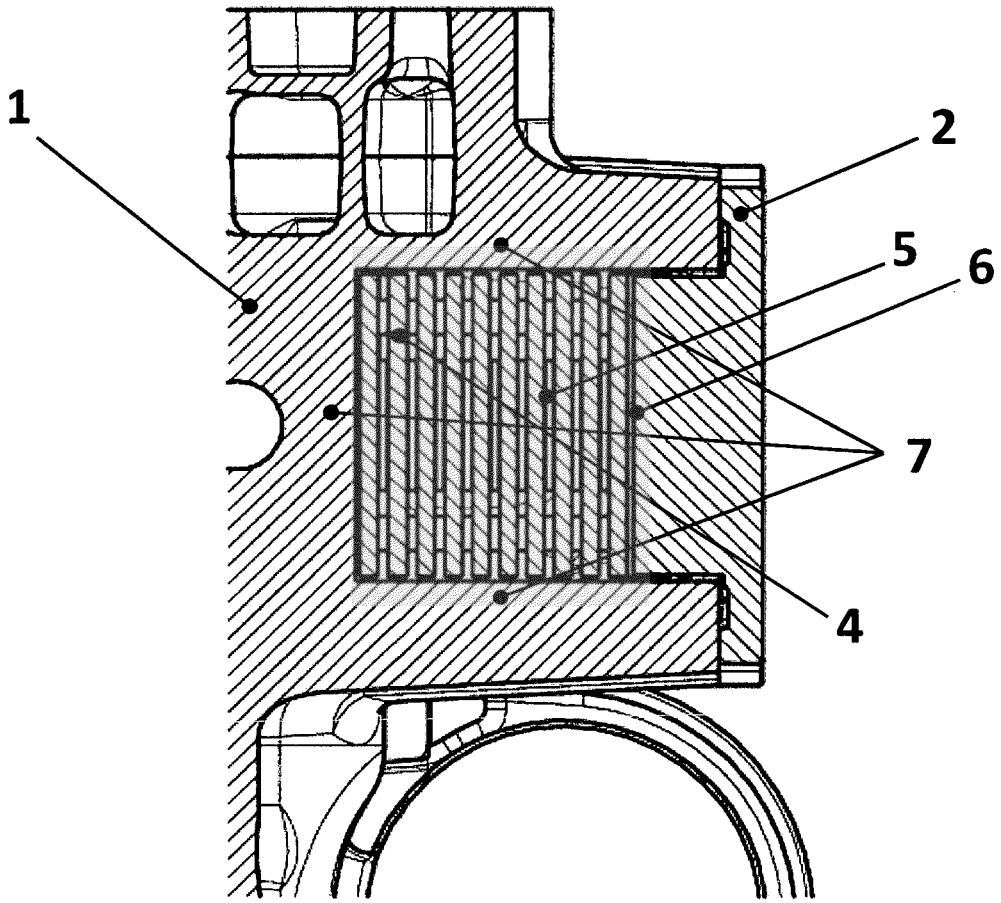
FIG. 5 shows section C-C from FIG. 2 of the installed oil cooler in cross section.

FIG. 3 shows oil cooler cover 2 with two interior guide ribs 6, which in the installed state are situated spatially opposite from cast metal ribs 7, as also shown in the cross section in FIG. 5.

Figure 4:
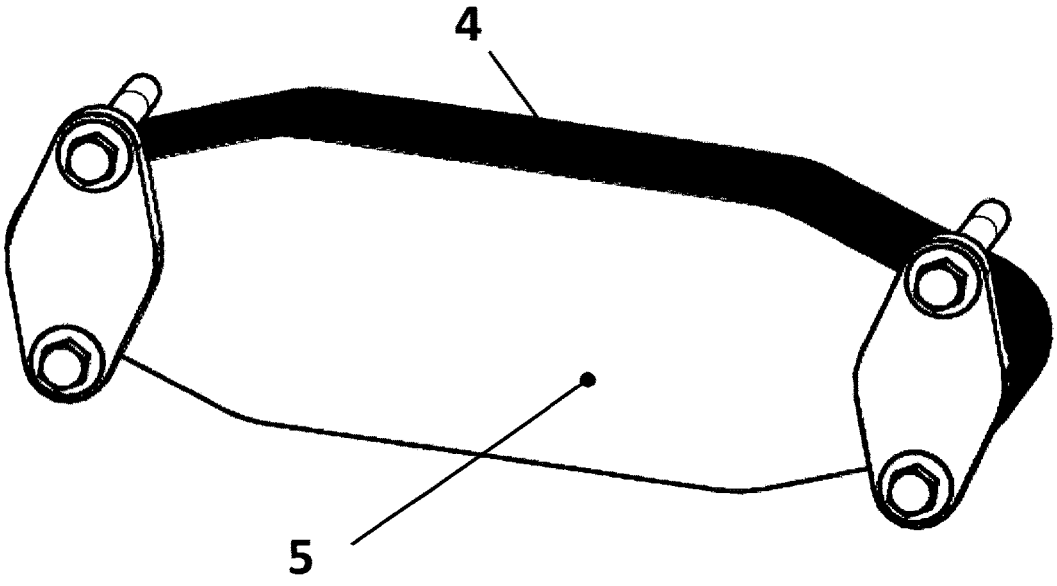
FIG. 4 shows an oil cooler.

FIG. 4 illustrates oil cooler 5 together with its cooler lamellae 4 and the sheet metal screw connections for accommodating oil cooler 5 on oil inlet and oil outlet flanges 8 and 9, respectively, from FIG. 2.

FIG. 5 shows section C-C from FIG. 2 with installed oil cooler 5 in cross section.

Cooling water guide ribs 6 are mounted at oil cooler cover 2, and cast metal ribs 7 are inserted into crankcase receptacle 3, as are apparent in FIGS. 2 and 5. Cast metal ribs 7 in crankcase 1 and cooling water guide ribs 6 in oil cooler cover 2 are led up to oil cooler 5 except for a small gap, as illustrated in FIG. 5. In this way, the leakage cross section, except for the remaining gap, is greatly reduced. To reduce the tolerance-related variance in the gap width and thus the variation in the throttle effect, cast metal ribs 7 are machined on the crankcase side. Due to the small rib width, only little material is cut away, and therefore the machining time of crankcase 1 is only slightly increased. In contrast, cooling water guide ribs 6 at oil cooler cover 2 do not necessarily have to be machined, since the tolerances in die-casting are already sufficiently precise. In FIG. 2, flow passes longitudinally through oil cooler 5, and the oil cooler, in a type of crankcase receptacle 3, is situated directly in crankcase 1 of the engine, without its own housing, as is also apparent in FIG. 1. The longitudinal flow allows the entire quantity of water of the engine to be provided to oil cooler 5 due to the large cross section through which flow passes. Sufficient energy is delivered from the oil to the water due to the longitudinal flow through oil cooler 5. This arrangement, due to its mode of operation, is ideal with regard to the cooling effect and pressure loss on the water side.

LIST OF REFERENCE NUMERALS

1 crankcase
2 oil cooler cover
3 crankcase receptacle
4 cooler lamellae
5 oil cooler
6 cooling water guide ribs
7 cast metal ribs
8 oil inlet
9 oil outlet
10 coolant inlet
11 coolant outlet

What is claimed is:

1. An internal combustion engine comprising:

a crankcase;

a cylinder head;

a cylinder block;

a crankcase receptacle integrated in the crankcase;

an oil cooler, which is accommodated in the crankcase receptacle and comprises an integrated oil passage;

a flat flange surface surrounding the crankcase receptacle for sealingly accommodating an oil cooler cover;

an oil inlet and an oil outlet to the oil cooler, wherein the oil inlet and the oil outlet both comprise flanges on which the oil cooler is situated; and an internal cooling section, with a coolant inlet to the oil cooler and a coolant outlet from the oil cooler, which are molded into the crankcase and open out into the crankcase receptacle;

wherein the crankcase comprises cast metal ribs and the oil cooler cover comprises cooling water guide ribs, wherein the cast metal ribs and the cooling water guide ribs are arranged to form a gap to the oil cooler.

2. The internal combustion engine as recited in claim 1, wherein the internal cooling section includes turbulence generators.

3. The internal combustion engine as recited in claim 1, wherein the coolant inlet to the oil cooler has a controllable configuration.

4. The internal combustion engine as recited in claim 1, further comprising panels and/or throttle devices between the oil cooler and the crankcase.

5. A method for operating an internal combustion engine comprising: providing the internal combustion engine as recited in claim 1; and operating the internal combustion engine.

6. An internal combustion engine comprising:

a crankcase including a receptacle;

an oil cooler accommodated in the receptacle; and a cover closing the receptacle and covering the oil cooler in a watertight manner, wherein the crankcase includes a flange bordering the receptacle and sealingly accommodating the cover;

wherein the receptacle includes cast metal ribs;

wherein the cover includes cooling water guide ribs;

wherein the crankcase includes a coolant inlet and a coolant outlet molded into the crankcase and opening out into the receptacle to allow coolant to flow longitudinally in the coolant inlet, around the oil cooler and out the coolant outlet.

7. The internal combustion engine as recited in claim 6, wherein the crankcase includes an oil inlet and an oil outlet opening up into the receptacle, the cast metal ribs being between the oil inlet and the oil outlet.

8. The internal combustion engine as recited in claim 7, wherein the cast metal ribs, the oil inlet and the oil outlet include flanges on which the oil cooler is situated.

9. The internal combustion engine as recited in claim 6, wherein the oil cooler include a plurality of cooler lamellae.

* * * * *